US010837173B2

(12) United States Patent
Yin et al.

(10) Patent No.: US 10,837,173 B2
(45) Date of Patent: Nov. 17, 2020

(54) BEAM-COLUMN CONNECTION STRUCTURE AND METHOD OF MAKING THE SAME

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 0 days.

(21) Appl. No.: 16/058,413

(22) Filed: Aug. 8, 2018

(65) Prior Publication Data

US 2019/0226206 A1 Jul. 25, 2019

Related U.S. Application Data

(63) Continuation of application No. 16/039,610, filed on Jul. 19, 2018, now abandoned.

(30) Foreign Application Priority Data

Jan. 23, 2018 (TW) ..... 107102291 A

(51) Int. Cl.
*E04C 2/06* (2006.01)
*E04G 21/14* (2006.01)
(Continued)

(52) U.S. Cl.
CPC ..... *E04C 2/06* (2013.01); *E04B 1/04* (2013.01); *E04B 1/215* (2013.01); *E04G 21/142* (2013.01)

(58) Field of Classification Search
CPC ..... E04B 1/04; E04B 1/21; E04B 1/215
See application file for complete search history.

(56) References Cited

U.S. PATENT DOCUMENTS 2,569,669 A * 10/1951 Henderson ..... E04B 1/21 52/283
6,178,714 B1 1/2001 Carney
(Continued)

FOREIGN PATENT DOCUMENTS

CN 102733486 A 10/2012
CN 203346872 U 12/2013
(Continued)

OTHER PUBLICATIONS

16058413_2019-10-25_KR_2017027235_A_I.pdf, Won K H (Year: 2017).*

(Continued)

*Primary Examiner* — Babajide A Demuren
(74) *Attorney, Agent, or Firm* — Juan Carlos A. Marquez; Marquez IP Law Office, PLLC

(57) ABSTRACT

The subject invention relates to a beam-column connection structure and method of making the same wherein the beam-column connection structure includes: a precast column comprising a plurality of tension bars horizontally embedded in the precast column; a precast beam comprising a metal plate fastened to an end surface of the precast beam, the metal plate having a plurality of through holes; and a plurality of fasteners, wherein each of the fasteners respectively penetrates through each of the through holes of the metal plate and connects to an end of a corresponding tension bar so that the precast beam is fixed to the precast column.

15 Claims, 8 Drawing Sheets

(51) Int. Cl.

| | |
|---|---|
| ***E04B 1/04*** | (2006.01) |
| ***E04B 1/21*** | (2006.01) |

(56) References Cited

U.S. PATENT DOCUMENTS

| | | | | |
|---|---|---|---|---|
| 6,293,071 | B1 * | 9/2001 | Konstantinidis | E04C 5/02 52/659 |
| 8,359,797 | B2 * | 1/2013 | Lee | E04B 1/04 249/19 |
| 10,378,199 | B2 * | 8/2019 | Calderon Uriszar-Aldaca | E04B 1/215 |
| 2004/0231278 | A1 * | 11/2004 | Yin | E04C 5/0609 52/649.4 |
| 2007/0261356 | A1 * | 11/2007 | Vaughn | E02D 27/34 52/655.1 |
| 2013/0239516 | A1 * | 9/2013 | Vaughn | E02D 27/34 52/849 |
| 2017/0051495 | A1 * | 2/2017 | Zavitz | E04C 3/34 |
| 2018/0291611 | A1 * | 10/2018 | Sugaya | E04B 1/5837 |

FOREIGN PATENT DOCUMENTS

| | | | | | |
|---|---|---|---|---|---|
| CN | 105937267 | A | | 9/2016 | |
| CN | 102561595 | A | | 7/2017 | |
| CN | 206800791 | U | | 12/2017 | |
| DE | 202017107261 | U | * | 3/2019 | E04B 1/215 |
| TW | 517741 | U | | 1/2003 | |
| TW | 1220017 | B | | 5/2005 | |
| WO | WO-2017031136 | A1 | * | 2/2017 | E04B 1/483 |
| WO | WO-2017192107 | A1 | * | 11/2017 | E04H 9/024 |

OTHER PUBLICATIONS

16058413_2019-10-25_KR_2018122152_A_I.pdf, Hong W K et al. (Year: 2018).*

Taiwan Office Action with Search Report dated Jan. 9, 2019, by the Taiwan Intellectual Property Office in the counterpart Taiwan Application No. 107102291, 6 pages in Chinese.

Chinese First Office Action with Search Report dated Apr. 14, 2020 in the counterpart Chinese Application No. 201810063321.4, 9 pages.

* cited by examiner

BEAM-COLUMN CONNECTION STRUCTURE AND METHOD OF MAKING THE SAME

This application is a continuation of U.S. patent application Ser. No. 16/039,610, filed on Jul. 19, 2018, which claimed priority to Taiwanese, Republic of China Patent Application No. TW 107102291 filed Jan. 23, 2018, the disclosures of which in their entirety are incorporated by reference.

TECHNICAL FIELD

The present invention relates to a beam-column connection structure and method of making the same, in particular to a beam-column connection structure and method of making the same for the connection of a precast column and a precast beam.

BACKGROUND

Conventional methods of constructing reinforced concrete (RC) buildings require construction floor-by-floor from the bottom to the top, which makes them time consuming. One of such methods involves: pouring concrete into molds having rebar therein at the construction site for construction at the ground floor and waiting until the concrete reaches a predetermined compression strength, then removing the molds and starting the constructing work for the next floor (i.e., the $2^{nd}$ floor), and so on. The quality of construction done in accordance with such conventional method is difficult to control. To resolve the above problems, a precast construction method is provided. For example, precast columns and precast beams are first fabricated in the factory, and then transported to the construction site to be hoisted to particular locations. At the construction site, the precast columns and beams are assembled by the steps of: binding the rebar extending from the outer surfaces of the precast columns and the precast beams, assembling the molds around the joints of the precast columns and beams, and pouring concrete into the molds to complete the beam-column connection structure. However, the accuracy of such conventional beam-column connection structure highly depends on the skill and experience of the workers on site. Thus, it is still hard to control construction quality, and it is desirable to reduce the time required further and improve the strength of such beam-column connection.

Given the above disadvantages of the above conventional methods, it is desired to provide a beam-column connection structure with stronger structural strength and to provide a construction method that can facilitate rapid assembly of a precast column and a precast beam.

SUMMARY OF INVENTION

In one aspect of the invention, a beam-column connection structure is provided that comprises: a precast column comprising a plurality of tension bars horizontally embedded in the precast column; a precast beam comprising a metal plate fastened to an end surface of the precast beam, the metal plate having a plurality of through holes; and a plurality of fasteners; wherein each of the fasteners penetrates through a through hole of the metal plate and connects to an end of a corresponding tension bar so that the precast beam is fixed to the precast column.

In another aspect of the invention, a method for constructing a beam-column connection structure is provided that comprises the following steps: (a) providing a precast column comprising a plurality of tension bars horizontally embedded inside the precast column; (b) providing a precast beam comprising a metal plate fixed to an end surface of the metal plate, wherein the metal plate has a plurality of through holes; (c) respectively penetrating each of a plurality of fasteners through each of the plurality of through holes of the metal plate from the side of the precast beam toward the side of the precast column; and (d) connecting each of the plurality of fasteners penetrating through each of the corresponding through holes of the metal plate to an end of a corresponding tension bar.

Other embodiments of the present invention and detailed advantageous features can be appreciated from the following Brief Description of the Drawings and Detailed Description.

DETAILED DESCRIPTION

Figure 1A:
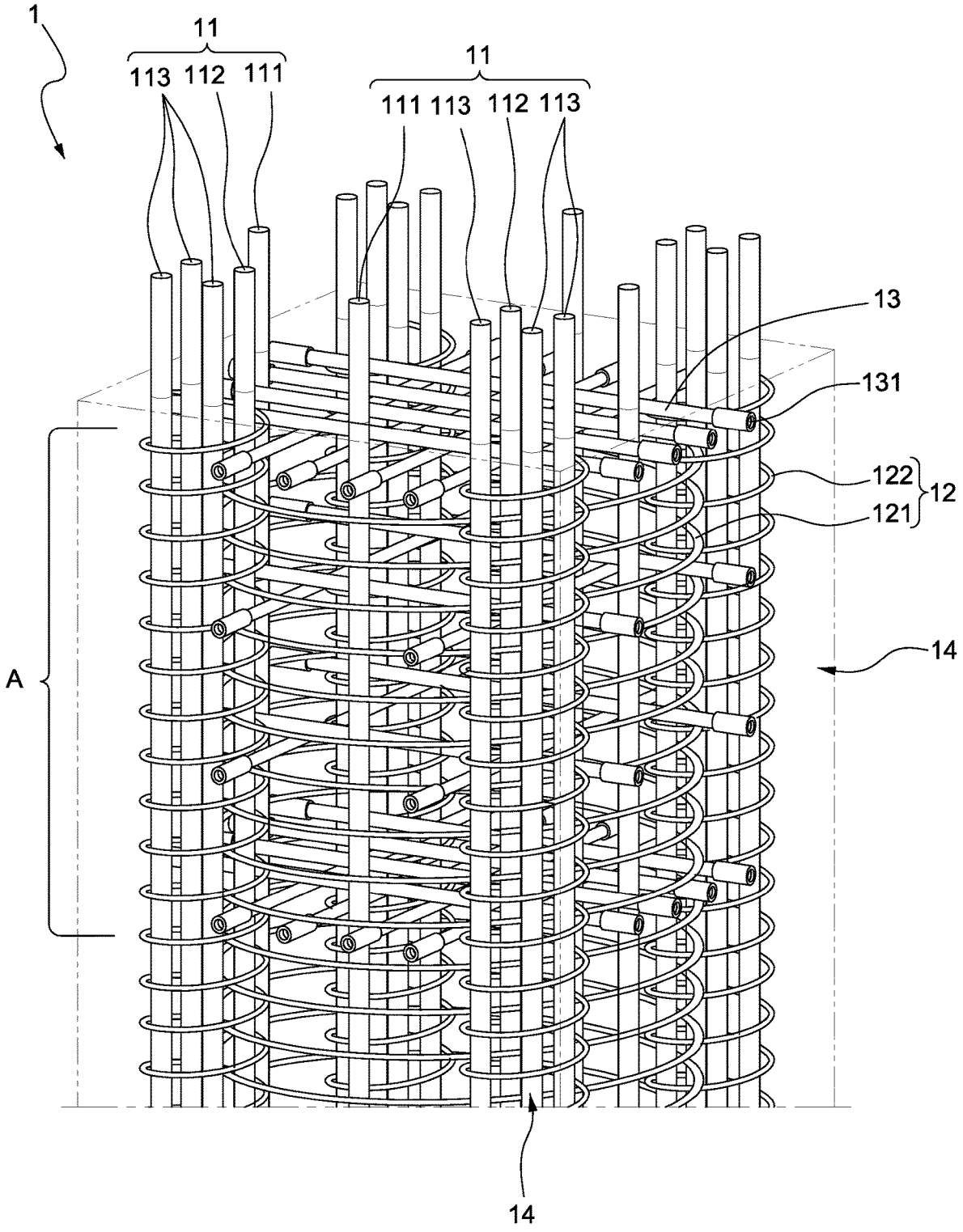
FIG. 1A illustrates a preferred embodiment showing a perspective view of the inside of a precast column.

In order to facilitate understanding of the technical features, technical contents, technical advantages and technical effects of the subject invention, a detailed description with accompanying drawings is provided below for explanation only. The drawings only serve an auxiliary purpose for understanding of the technical contents; the scope of the subject invention should not be interpreted merely based on the scale or the relative positions between the elements illustrated in the drawings.

The terminology used in the description of the present disclosure herein is for the purpose of describing particular embodiments only, and is not intended to be construed as a limitation of the invention. As used in the description of the invention and the appended claims, the singular articles "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including,"

"comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1B:
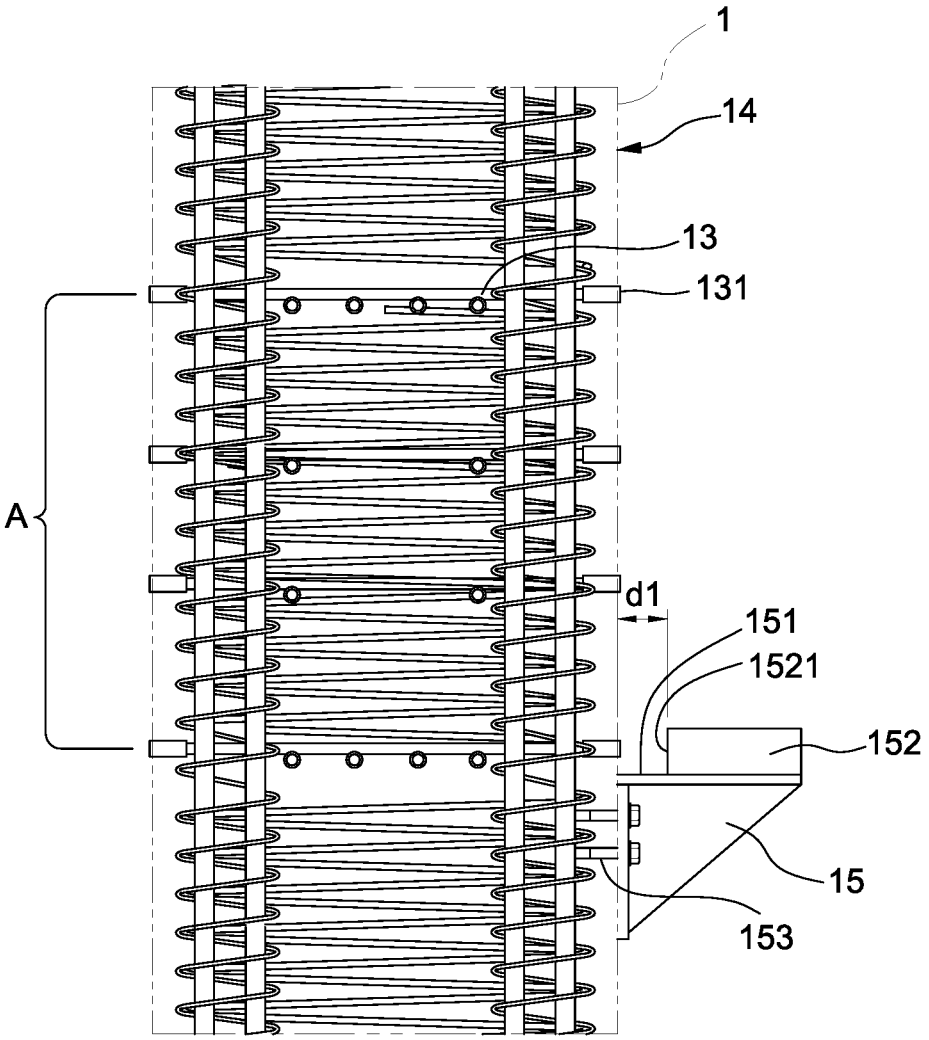
FIG. 1B illustrates an exemplary side view showing the precast column of FIG. 1A coupled with a bracket.

FIG. 1A illustrates a perspective view of a preferred embodiment showing the inside of a precast column, while FIG. 1B illustrates an exemplary side view showing the precast column 1 of FIG. 1A coupled with a bracket 15. Referring to the FIGS. 1A and 1B, the precast column 1 includes a first main rebar assembly 11 and a first stirrup assembly 12 fixedly coupled to the first main rebar assembly 11. In the present embodiment, the first stirrup assembly 12 is a spiral stirrup assembly, and comprises a first main spiral stirrup 121 and a plurality of first auxiliary spiral stirrups 122. In the embodiment shown in FIG. 1A, the precast column 1 comprises four first auxiliary spiral stirrups 122 respectively arranged outside the four corners of the first main spiral stirrup 121. In particular, the first auxiliary spiral stirrups 122 partially extend inside the first main spiral stirrup 121, i.e., each of the first auxiliary spiral stirrups 122 partially overlaps the first main spiral stirrup 121 and a major part of the first auxiliary spiral stirrups 122 are disposed outside the first main spiral stirrup 121.

In addition, the first main rebar assembly 11 comprises a plurality of main rebar inserted inside and fixedly coupled to the first auxiliary spiral stirrups 122 and/or the first main spiral stirrup 121 through binding with thin metal wires or through welding. As illustrated in FIGS. 1A and 1B, the first main rebar assembly 11 comprises a first set of inner main rebar 111 coupled to the inner side of the first main spiral stirrup 121 so that the first main spiral stirrup 121 surrounds and connects to outer sides of the first set of inner main rebar 111, a first set of middle main rebar 112 is disposed between and fixedly coupled to the first main spiral stirrup 121 and the plurality of the first auxiliary spiral stirrups 122, and a first set of outer main rebar 113 is disposed outside of the first main spiral stirrup 121 and inside of the plurality of the first auxiliary spiral stirrups 122, and fixedly coupled to the plurality of the first auxiliary spiral stirrups 122.

Furthermore, as illustrated in FIGS. 1A and 1B, the precast column 1 comprises at least one beam-column connection area A where a plurality of tension bars 13 for connecting to a precast beam 2 are horizontally embedded in the precast column 1. The tension bars 13 are embedded and positioned to cross the whole length or the whole width of a horizontal cross section of the precast column 1. At least one end (or both ends) of each of the tension bars 13 comprises a coupling structure such as a threaded hole 131 for mounting the precast beam 2. The end coupling structure of the tension bar (for example, the threaded hole 131) is exposed on the lateral surface 14 of the precast column 1 so that the precast beam 2 can be fixedly mounted thereto. As illustrated in FIGS. 1 A and 1B, the end surface of the tension bar 13 is flush with the lateral surface 14 of the precast column 1 so that the threaded hole 131 is exposed and accessible from the lateral surface 14 of the precast column 1. In addition, the number and distribution of the tension bars 13 in the beam-column connection area A are determined based on the size and weight of the precast column 2 to be mounted thereon. As an exemplary embodiment shown in FIGS. 1A and 1B, the threaded holes 131 of the ends of the tension bars 13 are generally distributed as a rectangular shape on the opposed lateral surfaces 14 of the beam-column connection area A for mounting precast beams 2.

To facilitate the assembly of the precast beam 2 with the precast column 1 or to sustain at least a part of the weight of the same, as an exemplary embodiment, a bracket 15 may be further mounted to the lateral surface 14 of the precast column 1 beneath the beam-column connection area A. FIG. 1B illustrates that the bracket 15 is pre-mounted to the lateral surface 14 of the precast column 1 via screws 153 or other types of fasteners. The bracket 15 comprises an upper surface 151 on which one or more raising blocks 152 may be placed. In the present embodiment, two raising blocks 152 are placed on the upper surface 151 of the bracket 15. A gap d1 is provided between the lateral surface 14 of the precast column 1 and an end surface 1521 of the raising blocks 152 facing toward the lateral surface 14. The number and thickness of the raising blocks 152 may be determined in accordance with the shape and size of the precast beam 2.

Figure 2A:
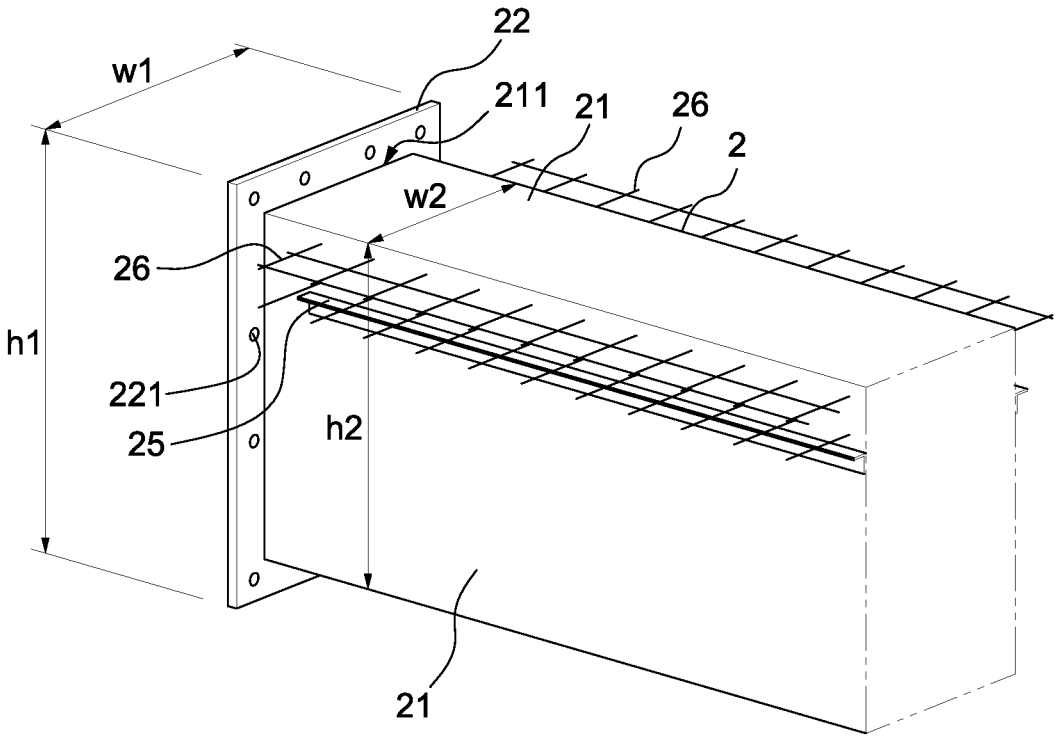
FIG. 2A illustrates a perspective view showing the structures of the precast beam of a preferred embodiment.
Figure 2B:
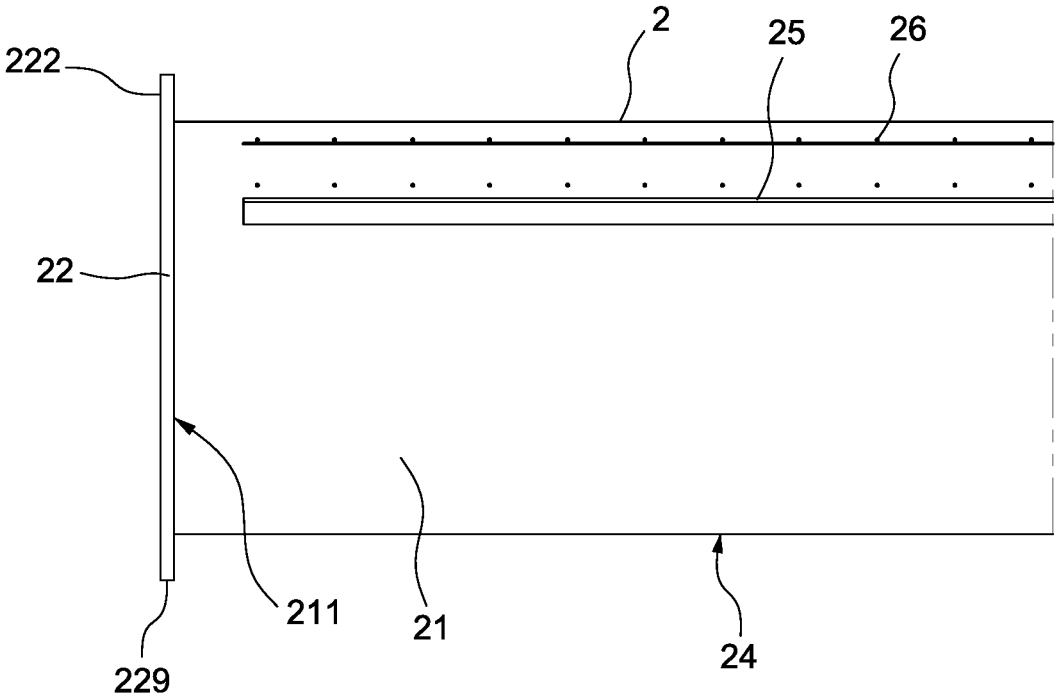
FIG. 2B illustrates a side view of the precast beam of FIG. 2A.

FIG. 2A illustrates a precast beam 2 in accordance with a preferred embodiment. FIG. 2B illustrates a lateral view of the precast beam 2 shown in FIG. 2A. Referring to FIGS. 2A and 2B, a metal plate is 22 is fastened to an end surface 211 of one end 21 of the precast beam 2. The metal plate 22 comprises a plurality of through holes 221 which are formed to respectively align with the corresponding threaded holes 131 of the tension bars 13. Furthermore, the metal plate 22 is fixed to the end surface 211 of the end 21 of the precast beam 2 by means such as a plurality of bolts (not shown), and the end surface of each bolt head is flush with an end surface 222 of the metal plate. However, it should be noted that the combination of the metal plate 22 and the precast beam 2 is not limited to such manner. The width w1 of the metal plate 22 is sized to be greater than or at least equal to the width w2 of the end surface 211 of the precast beam 2, while the height h1 of the metal plate 22 is sized to be at least equal to or greater than the height h2 of the of the end surface 211 of the precast beam 2. In a preferred embodiment, the width w1 and the height h1 of the metal plate 22 are both greater than the width w2 and the height h2 of the end surface 211 of the precast beam 2. Each of the lateral surfaces of the precast beam 2 has a support bar 25 and a plurality of side rebar 26. The support bar 25 is used for supporting a floor structure such as the corrugated steel sheets serving as the bottom of the floor panel. The side rebar 26 can be further combined with other rebar to form the rebar structure for the formation of the floor panel.

Figure 3:
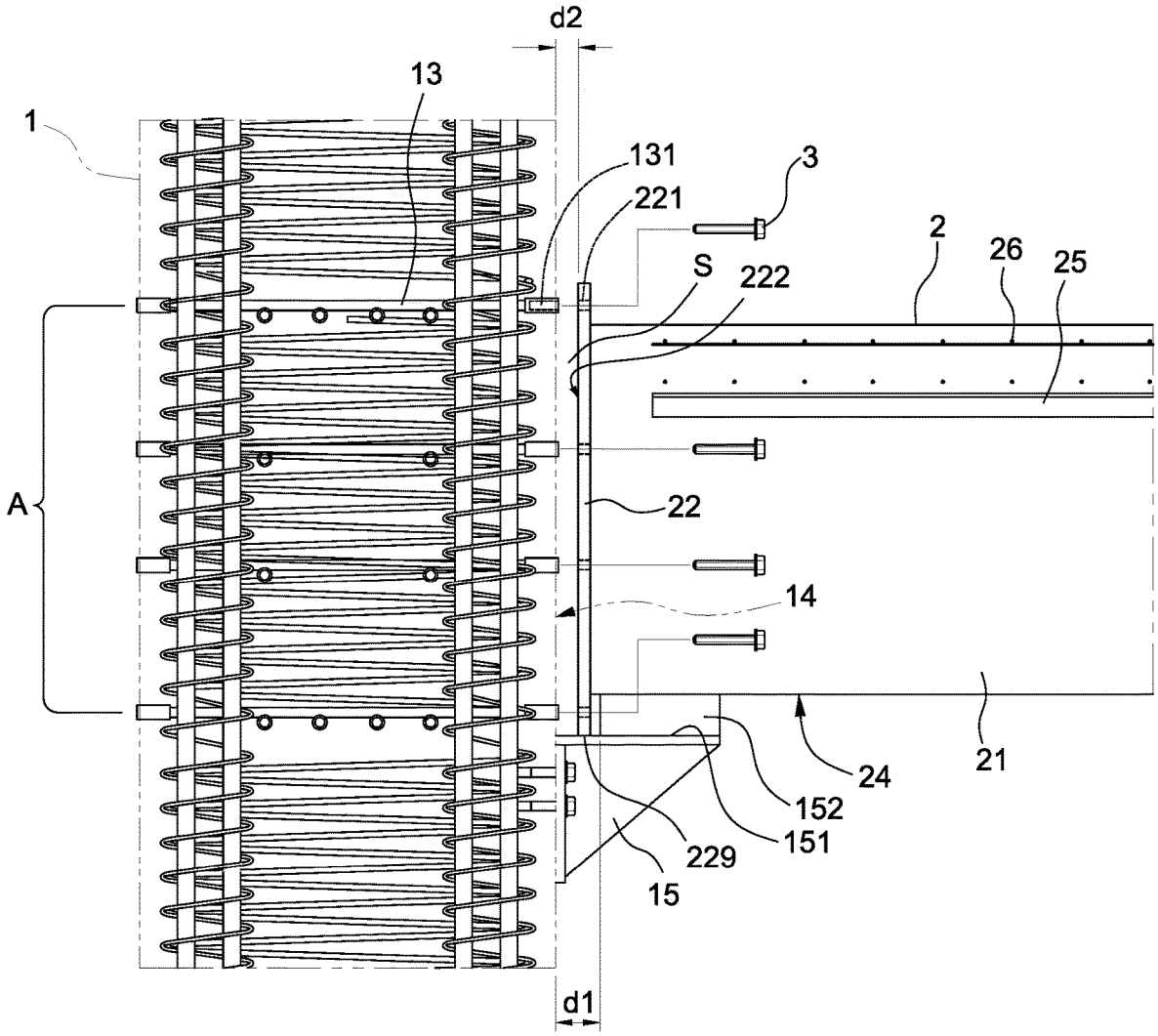
FIG. 3 illustrates a side view showing a step of assembling the precast beam and the precast column in accordance with a preferable embodiment of the instant disclosure.
Figure 4A:
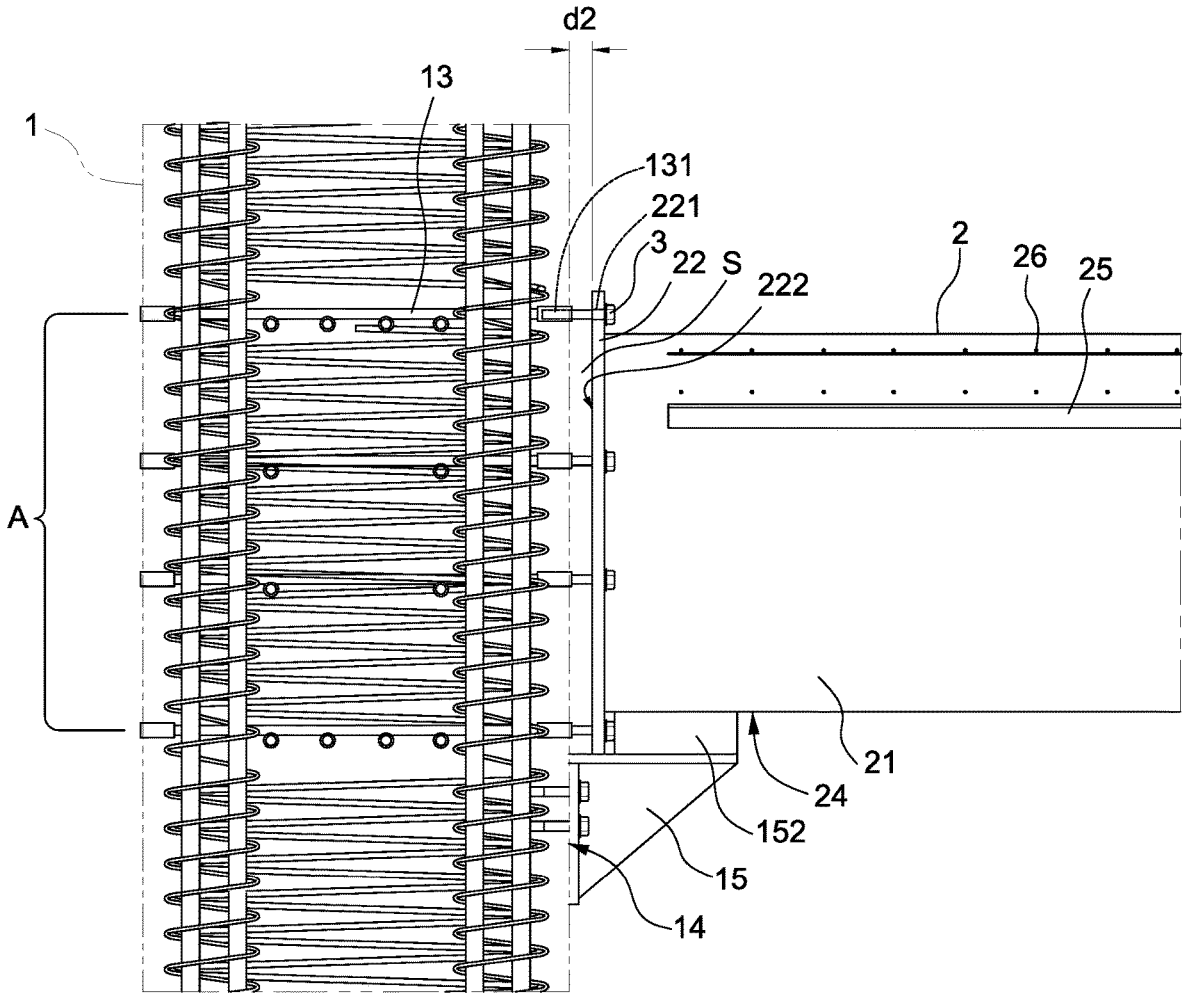
FIG. 4A illustrates a side view showing another step of assembling the precast beam and the precast column in accordance with the preferable embodiment of the instant disclosure.

In a preferred embodiment, the structural body of the precast column 1 and the precast beam 2 are manufactured in the precast factory according to construction blueprints. After the concrete of the precast column 1 and the precast beam 2 reaches a predetermined rigidity, the precast column 1 and the precast beam 2 are transported to the construction site for assembly. FIG. 3 to FIG. 5 illustrate the process of assembling the precast beam 2 and the precast column 1. Referring to FIG. 3, after the precast column 1 is hoisted and positioned at a predetermined position at the construction site, a crane (not shown) hoists the precast beam 2 to a position adjacent to the beam-column connection area A of the precast column 1 for the subsequent work of connecting the precast beam 2 to a predetermined position of the precast column 1. In order to facilitate the adjustment of the position of precast beam 2 relative to the precast column 1, the bracket 15 is mounted to the position of the precast column 1 as shown in FIG. 1B after either the fabrication of the precast column 1 in the factory or positioning the precast column 1 at the construction site. Meanwhile, a required number of raising blocks 152 having an appropriate thickness is determined based on the level of the bottom surface 24 at the end 21 of the precast beam 2. In the present embodiment, the thickness of the raising blocks 152 is generally equal to the vertical height difference between the lower end surface 229 of the metal plate 22 and the bottom surface 24 of the precast beam 2. The raising blocks 152 are designed to be replaceable so that if deformation thereof is caused by sustaining the weight of the beam-column connecting structure for a long period of time or by other unexpected events, the height of the bottom surface 24 at the end 21 of the of the precast beam 2 can be readjusted by replacing the raising blocks 152 with those having the same or different thickness.

Referring to FIG. 3, at least a portion of the lower end surface 229 of the metal plate 22 of the precast beam 2 rests on the upper surface 151 of the bracket 15, and the bottom surface 24 of the end 21 of the precast beam 2 simultaneously rests on the top surfaces of the raising blocks 152 positioned on the upper surface 151 of the bracket 15. With the support provided by the bracket 15 for the end 21 of the precast beam 2, workers are able to further adjust the position of the precast beam 2 relative to the precast column 1 so that the through holes 221 formed on the metal plate 22 respectively align with the corresponding threaded holes 131 exposed on the lateral surface 14 of the precast column 1. In another embodiment (not shown), neither the bracket 15 nor the raising blocks 152 mounted to the precast column 1 are provided. While the precast beam 2 is hoisted adjacent to the beam-column connection area A of the precast column 1 by the crane, the adjustment of the position of the precast beam 2 relative to the precast column 1 is accomplished directly by experienced labor so that the through holes 221 formed on the metal plate 22 are able to respectively align with the corresponding threaded holes 131 exposed on the lateral surface 14 of the precast column 1. It should be noted that a gap d2 is left between the end surface 222 of the metal plate 22 of the precast beam 2 and the lateral surface 14 of the precast column 1, and thus a space S is formed between the opposed surfaces of the metal plate 22 and the precast beam 1. The gap d2, however, is smaller than the gap d1 formed between the end surface of the raising block 152 and the lateral surface 14 of the precast column 1.

After accurately positioning the precast beam 2 with respect to the precast column 1 as illustrated in FIG. 3, a plurality of fasteners 3 are used for being respectively penetrated through the corresponding through holes 221 of the metal plate 22 horizontally from the side of the precast beam 2 toward the side of the precast column 1. Subsequently, the plurality of fasteners 3 penetrating the corresponding through holes 221 of the metal plate 22 are further connected to the ends of the corresponding tension bars 13 respectively. In the embodiment shown in FIGS. 4A and 4B, each of the fasteners 3 is in the form of a thread bolt having a threaded end 31, and is preferably a high-tension bolt. Each of the fasteners 3 is screwed into the threaded hole 131 of the corresponding tension bar 13 after penetrating through the metal plate 22 so that the precast beam 2 is fixed to the precast column 1.

In addition, with the gap d2 between the lateral surface 14 of the precast column 1 and the metal plate 22 of the precast beam 2, workers are able to adjust the relative angle between the end surface 22 of the metal plate 22 of the precast beam 2 and the lateral surface 14 of the precast column 1 so that the two surfaces are as parallel to each other as possible as when the fasteners 3 are screwed into the corresponding threaded holes 131. Under this arrangement, the precast beam 2 is able to be fixed to the precast column 1 with sufficient horizontal accuracy after all the fasteners 3 are screwed into the corresponding threaded holes 131 so as to reduce deviation during the assembly process. In an alternative embodiment (not shown), under the condition that both the lateral surface 14 of the precast column 1 and the end surface 222 of the metal plate 22 are sufficiently flat, it is also feasible to directly fix the metal plate 22 of the precast beam 2 onto the lateral surface 14 of the precast column 1 through the fasteners 3, and thus no gap is required in such embodiment.

Figure 4B:
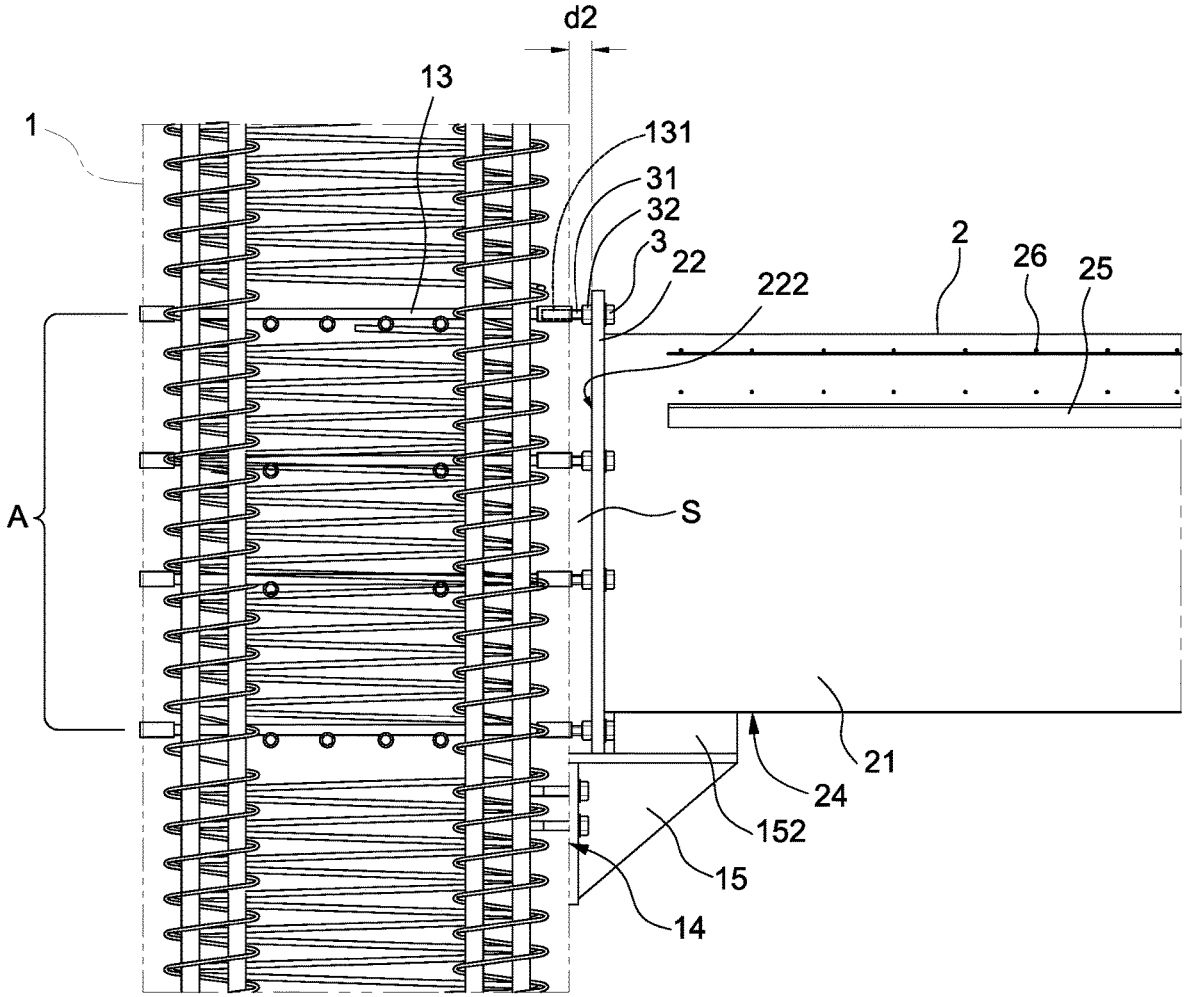
FIG. 4B illustrates a side view showing a further step of assembling the precast beam and the precast column in accordance with the preferable embodiment of the instant disclosure.
Figure 5:
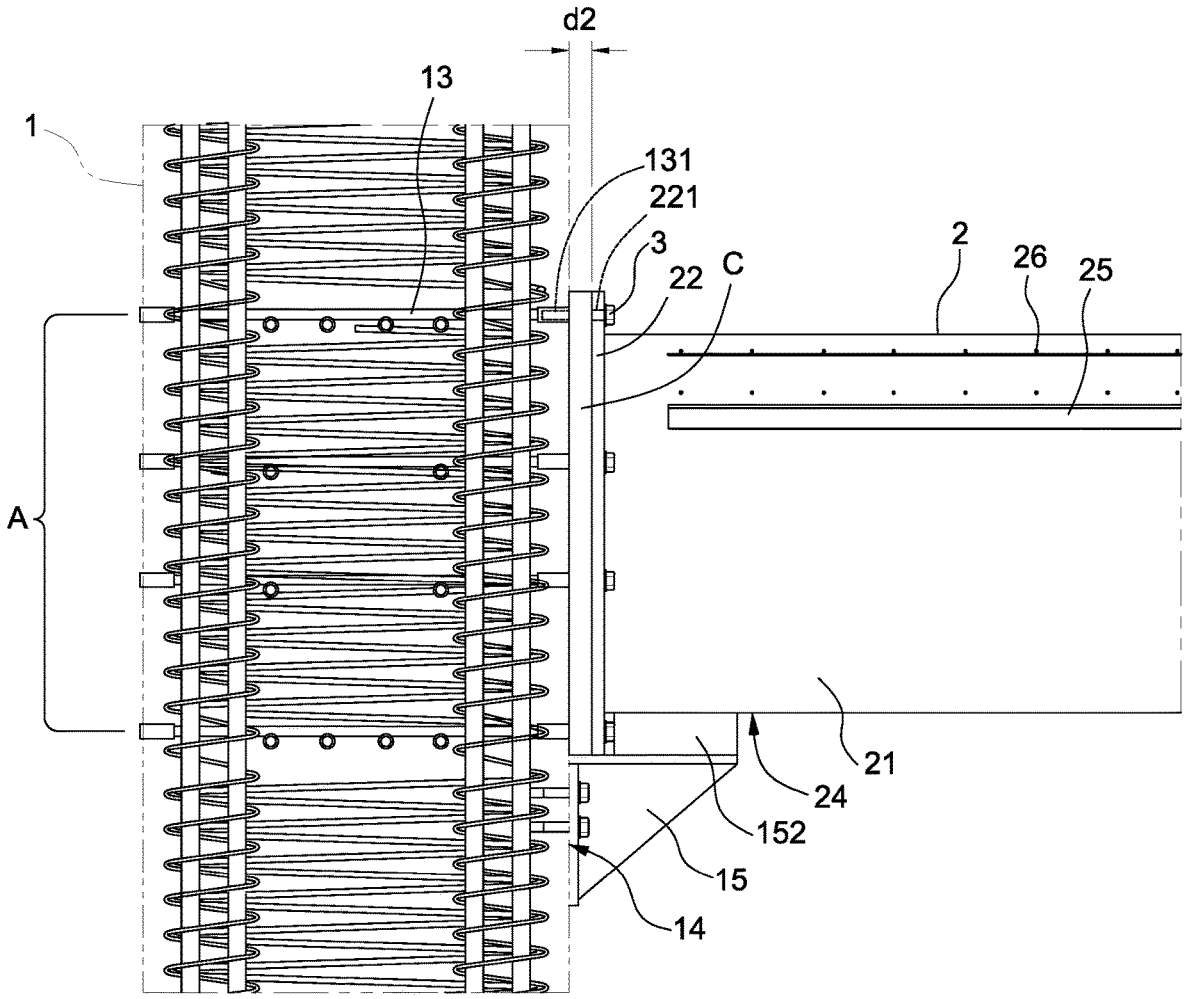
FIG. 5 illustrates a side view showing a still further step of assembling the precast beam and the precast column in accordance with the preferable embodiment of the instant disclosure.

Moreover, as shown in FIG. 4B, the threaded end 31 of each of the fasteners 3 can be further coupled with another fastening element 32 after the fasteners 3 penetrate the corresponding plurality of through holes 221 of the metal plate 22, and then the fasteners 3 are respectively connected to the ends of the corresponding tension bars 13. The fastening element 32 can be, for example, a nut. After the fasteners 3 are coupled to the corresponding tension bars 13 of the precast column 1, the fastening elements 32 (such as nuts) are respectively moved toward the end face 222 of the metal plate 22 to tightly sandwich the metal plate 22 with the fasteners 3. In this way, the relative position between the precast column 1 and the precast beam 2 remains stable.

Figure 6:
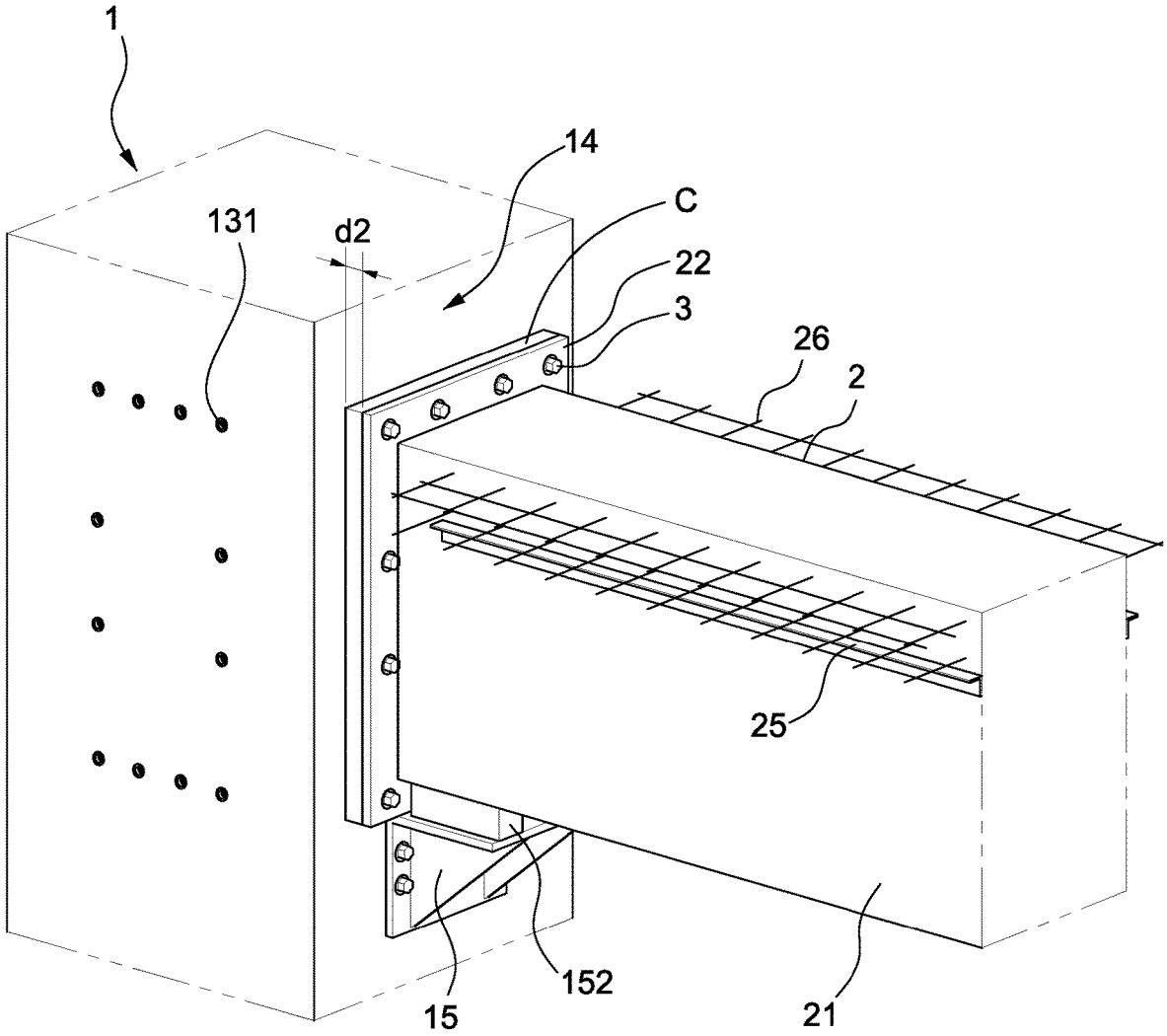
FIG. 6 illustrates a perspective view showing the beam-column connection structure of a preferred embodiment of the instant disclosure.

Referring to FIGS. 5 and 6, molds are placed along the two side edges of the metal plate 22 to enclose the space formed by the gap d2 after the precast beam 2 is fixedly mounted to the precast column 1 with sufficient horizontal accuracy. Subsequently, cement mortar is poured to fill the space S. After the cement mortar is solidified, the molds are removed and the beam-column connection structure of the precast column 1 and the precast beam 2 is completed. The bracket 15 and the raising blocks 152 can be removed after the above beam-column connection structure is completed so that they can be reused for the combination of the other precast columns 1 and the precast beams 2. Alternatively, the bracket 15 and the raising blocks 152 can be permanently preserved at the precast column 1 to provide a permanent support for the precast beam 2. As can be understood, in the embodiment where the metal plate 22 of the precast beam 2 is directly fixed to the lateral surface 14 of the precast column 1 through fasteners 3 (i.e., no gap space S exists), the step of pouring cement mortar as mentioned above is not required.

The beam-column connection structure and the method of forming the same as provided in the above embodiments effectively speed up the connections between the precast columns and the precast beams and therefore the main structure of the building can be rapidly accomplished. Moreover, the tension bars embedded in the precast column not only enhance the structural strength of the precast beams coupled to both ends of each tension bar, but also effectively transmit the shear force resulting from earthquakes so as to prevent the beam-column connection structure from being damaged due to the unfavorable stress concentration phenomenon.

Specific components of an insertion system and related methods for insertion have been described. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the present disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A beam-column connection structure, comprising:

a precast column comprising a plurality of tension bars horizontally embedded in the precast column;

a precast beam comprising a metal plate fastened to an end surface of the precast beam and having no rebar protruding out of the end surface of the precast beam, the metal plate having a plurality of through holes; and a plurality of fasteners;

wherein each of the fasteners penetrates through a through hole of the metal plate and connects to an end of a corresponding tension bar so that the precast beam is fixed to a lateral surface of the precast column; and wherein a gap exists between the opposed surfaces of the metal plate and the precast column, and the gap is filled with cement mortar.

2. The beam-column connection structure according to claim 1, wherein at least one end of each of the tension bars is formed with a threaded hole, and wherein each of the fasteners has a threaded end for being screwed into the threaded hole of the corresponding tension bar.

3. The beam-column connection structure according to claim 2, wherein each of the fasteners is a high-tension bolt.

4. The beam-column connection structure according to claim 1, further comprising a bracket mounted to the lateral surface of the precast column, the bracket being disposed beneath an end of the precast beam for supporting the end of the precast beam.

5. The beam-column connection structure according to claim 4, wherein the bracket comprises an upper surface for supporting at least a portion of a lower end surface of the metal plate.

6. The beam-column connection structure according to claim 4, wherein the bracket comprises an upper surface, and the beam-column connection structure further comprises at least one raising block positioned on the upper surface of the bracket for supporting the end of the precast beam.

7. The beam-column connection structure according to claim 1, wherein the width of the metal plate is greater than that of the end surface of the precast beam.

8. The beam-column connection structure according to claim 1, wherein the vertical length of the metal plate is greater than that of the end face of the precast beam.

9. The beam-column connection structure according to claim 1, wherein the precast column comprises a first main rebar assembly and a first stirrup assembly fixedly coupled to the first main rebar assembly, wherein the first stirrup assembly comprises a first main spiral stirrup and a plurality of first auxiliary spiral stirrups, wherein the plurality of the first auxiliary spiral stirrups partially overlap the first main spiral stirrup and a major part of the first auxiliary spiral stirrups are disposed outside the first main spiral stirrup.

10. The beam-column connection structure according to claim 9, wherein the first main rebar assembly comprises:

a first set of inner main rebar, the first main spiral stirrup surrounding and connecting to outer sides of the first set of inner main rebar;

a first set of middle main rebar disposed between the first main spiral stirrup and the plurality of the first auxiliary spiral stirrups; and a first set of outer main rebar, disposed outside of the first main spiral stirrup and inside of the plurality of the first auxiliary spiral stirrups.

11. A method for constructing a beam-column connection structure, comprising the following steps:

(a) providing a precast column comprising a plurality of tension bars horizontally embedded inside the precast column;

(b) providing a precast beam comprising a metal plate fixed to an end surface of the precast beam and having no rebar protruding out of the end surface of the precast beam, wherein the metal plate has a plurality of through holes;

(c) respectively penetrating each of a plurality of fasteners through each of the plurality of through holes of the metal plate from the side of the precast beam toward the side of the precast column;

(d) connecting each of the plurality of fasteners penetrating through each of the corresponding through holes of the metal plate to an end of a corresponding tension bar so that the precast beam is fixed to a lateral surface of the precast column;

(e) preserving a gap between the opposed surfaces of the metal plate and the precast column while the of the precast beam is being positioned onto the upper surface of the bracket; and (f) filling the space with cement mortar.

12. The method according to claim 11, wherein at least the end of the corresponding tension bar is formed with a threaded hole, and each of the fasteners has a threaded end wherein step (d) is screwing each of the fasteners through each of the corresponding through holes of the metal plate into the threaded hole of the corresponding tension bar.

13. The method according to claim 11, further comprising the step of mounting a bracket to the lateral surface of the precast column prior to step (d).

14. The method according to claim 13, further comprising the step of positioning one end of the precast beam onto an upper surface of the bracket after step (c) and prior to step (d).

15. The method according to claim 14, wherein prior to the step of positioning the end of the precast beam onto the upper surface of the bracket, further providing at least one raising block and placing the at least one raising block onto the upper surface of the bracket so as to adjust the height of the end of the precast beam.

* * * * *